United States Patent [19]

Hays, Jr.

[11] Patent Number: 5,024,130

[45] Date of Patent: Jun. 18, 1991

[54] FLYKNIFE CUTTER FOR EXTRUDED MATERIALS

[75] Inventor: Donald F. Hays, Jr., Silver Lake Village, Ohio

[73] Assignee: Extrusion Services, Inc., Stow, Ohio

[21] Appl. No.: 335,832

[22] Filed: Apr. 10, 1989

[51] Int. Cl.[5] ..... B26D 1/26; B26D 5/12

[52] U.S. Cl. ..... 83/444; 83/526; 83/595; 83/639.5; 83/860; 83/554

[58] Field of Search ..... 83/42, 48, 257, 283, 83/548, 526, 554, 639.5, 591, 592, 594, 593, 444, 202, 860

[56] References Cited

U.S. PATENT DOCUMENTS

| | | | |
|---|---|---|---|
| 3,114,282 | 12/1963 | Reifenhäuser et al. | 83/526 |
| 3,142,218 | 7/1964 | Worral, Jr. et al. | 83/526 |
| 3,587,372 | 6/1971 | Prew | 83/554 |
| 3,727,505 | 4/1973 | Shaughnessy | 83/526 |
| 4,214,357 | 7/1980 | Delves | 83/554 |
| 4,319,504 | 3/1982 | Wepner et al. | 83/526 |

*Primary Examiner*—Mark Rosenbaum
*Assistant Examiner*—Scott A. Smith
*Attorney, Agent, or Firm*—Renner, Kenner, Greive, Bobak, Taylor & Weber

[57] ABSTRACT

Apparatus (10) for repeatedly severing rubber and plastic material (T) at selected locations along a length thereof including a frame (15), an arbor (41) mounted on the frame carrying a knife blade (50) for rotation in a circular path, a guide for supporting the material to be severed in the path of rotation of the knife blade, a rotary actuator (56) for selectively intermittently driving the arbor for instituting rotation of the knife blade, and a cylinder assembly (90) for supplementing the driving of the arbor and for braking the arbor to a stop after the knife blade has severed the material.

19 Claims, 3 Drawing Sheets

FLYKNIFE CUTTER FOR EXTRUDED MATERIALS

TECHNICAL FIELD

Generally, the invention relates to cutters for severing materials extruded in the rubber and plastics industry. More particularly, the invention relates to flyknife cutters which employ a rotating knife blade for severing rubber and plastic materials, commonly as part of on-line extrusion processing equipment. More specifically, the invention relates to a flyknife cutter head which operates on demand to repeatedly sever profile and tubing extrusions of rubber and plastic materials that are moving or stopped to produce accurately cut lengths of the material.

BACKGROUND ART

Extruders for rubber and plastic materials have been in use for many years. These extruders produce an endless flow of product having a cross-sectional configuration which is determined by the dies employed in the extruder. A primary application for this type of machinery, is in what is characterized as profile and tubing extrusion application industry. Exemplary types of products which are commonly so characterized include generally flat goods in the nature of seals or weatherstripping and tubular goods such as various types of hosing and tubing.

Depending upon the type of product in terms of cross-sectional configuration, material and other considerations, commercial extrusion operations normally consist of an extruder, suitable apparatus for curing the extruded material and apparatus for cutting the extruded material to predetermined lengths for a particular product. While both off-line and on-line cutting apparatus has been employed in the industry, off-line cutting operations are characteristically relatively expensive in terms of the equipment required and labor costs.

As a result, on-line cutoff machinery has long been used in the industry for cutting profile and tubing extrusions particularly. What is generally known as a flyknife cutter is the oldest and most widely used cutoff machine in the industry. Flyknife cutters are generally characterized by a knife blade being mounted for rotation through a cutting area with the knife blade being mounted in a plane perpendicular to the direction of travel of the extruded material through the cutoff machine. In order to provide for a clean precise severing of extruded material having relatively thick walls or of relatively large cross-sectional size, it is common for flyknife cutters to mount the knife blade on a flywheel to impart ample momentum to the knife blade for the requisite cutting action. Since the cutting cycle of a flyknife cutter must be accomplished in a single rotation of the flyknife, the use of the requisite flywheel presents technical problems which have plagued the rubber and plastic extrusion industry for many years. The basic problem has centered about the necessity for accelerating a flywheel carrying a knife blade to an angular velocity sufficient for cutting the extruded material, effecting the cutting action and stopping the flywheel, all within an angular rotation span of the knife blade through 360°.

Traditionally a combination clutch/brake, an associated drive motor, belting, bearings, and suitable electric controls have been employed for accelerating and then decelerating and stopping the flywheel. Since many products can be extruded at relatively rapid linear rates and since the finished products in many instances may be short, such as on the order of an inch or even fractions of an inch, it is often necessary that an on-line cutoff machine be capable of making as many as several hundreds operating repetitions per minute. It will be readily appreciated that great demands are placed on any clutch/brake configuration when subjected to repetition rates of this order. Many of the electromagnetic clutch/brake designs essentially self-destructed in a relatively short time due to high temperatures and the complex shaft and gearing arrangements.

For many years improvements in flyknife cutters were directed primarily to efforts to design improved electro-magnetic clutch and brake configurations and materials in an effort to meet these stringent demands, while somewhat obviating the significant repair and maintenance costs which were encountered in terms of both parts and labor in operatively maintaining such flyknife cutters. Some improvements in flyknife cutter technology over the years have been significant in providing improved performance while reducing maintenance and repairs. Noteworthy in this respect was the development of electrical overexcitation of the clutch/brake assembly to achieve more rapid and positive action. More recently, vacuum clutch/brake assemblies have been adopted by much of the industry to improve repeat cycle accuracy, since power and temperature fluctuations have minimal effect on the torque of a vacuum unit, and to provide lower operating temperatures. The use of self diagnostic clutch/brake assemblies to effect early detection of malfunctions and component wear has aimed at decreasing downtime and/or operation at cutting characteristics outside accepted tolerances.

While refinements of this type have to some extent reduced maintenance and repair and out-of-tolerance production, the clutch/brake assembly of flyknife cutters has remained the weak link in cutoff machines of this type. In fact, the clutch/brake assembly of the flyknife is widely considered to be possibly the most problematical component of an entire extrusion line.

DISCLOSURE OF THE INVENTION

Therefore, an object of the present invention is to provide a flyknife cutter for rubber and plastic materials which employs a totally different approach that eliminates the problems discussed above in relation to the prior art while ensuring a capability of high speed, consistent operation. Another object of the present invention is to provide such a flyknife cutter which substantially reduces the complications of prior cutters in terms of the sophistication of the components, the number of components, and the relative extent to which the components are operatively taxed by rapidly repeated operating cycles of the cutter. Still another object of the present invention is to provide such a flyknife cutter which is of highly flexible design in that it can be used as a table-top cutter, with or without length control, as a stand-alone "on demand" flyknife cutter, or as a retrofit in an existing flyknife cutter system. Yet another object of the invention is to provide such a flyknife cutter which can operate "on demand" in conjunction with a variety of motion control devices which measure and feed the extruded material, such as optical length sensors and associated material drive conveyors.

Another object of the present invention is to provide a flyknife cutter wherein the use of a clutch/brake assembly is obviated, thereby eliminating the problems associated with these assemblies when employed in conjunction with this type of machinery. Still another object of the invention is to provide such a flyknife cutter which provides all of the capabilities of conventional flyknife cutters but employs cylinders to provide acceleration and deceleration of the flywheel member carrying the knife blade. Still another object of the present invention is to provide such a flyknife cutter wherein the mechanical interconnection and orientation of a cylinder provides the requisite braking and stopping of the flywheel carrying the knife blade. Still another object of the invention is to provide such a flyknife cutter wherein a one directional clutch operating on the flywheel shaft operates in combination with a cylinder to bring the flywheel to a rapid, smooth stop.

Yet another object of the present invention is to provide a flyknife cutter which obviates the need for an electric motor or a vacuum pump and therefore obviates the problems attendant the usage of such devices. Yet a further object of the invention is to provide such a flyknife cutter which is capable of operating at repetition rates which are required for on-line operation with an extruder having current high speed capabilities. Yet another object of the invention is to provide such a flyknife cutter wherein the air cylinders actuating the flywheel carrying the cutter blade operate at moderate pressures which are readily available in manufacturing facilities, do not require specialized components, and can be inexpensively rebuilt after extensive operating times.

Still a further object of the invention is to provide a flyknife cutter which normally requires reduced maintenance in comparison with conventional units in that the cutter is capable of extended usage with the necessity for only knife blade replacement and lubrication. Still another object of the invention is to provide such a flyknife cutter wherein the initial cost is less than conventional flyknife cutters due to the type and number of components employed in the cutter. Yet another object of the invention is to provide such a flyknife cutter wherein the cost of repair and/or replacement of wear components is substantially less than is experienced with conventional cutoff machines. A still further object of the invention is to provide a flyknife cutter which is designed to employ components which can withstand conventional factory environments without undue service or repair necessitated by environmental conditions.

PREFERRED EMBODIMENT FOR CARRYING OUT THE INVENTION

Figure 1:
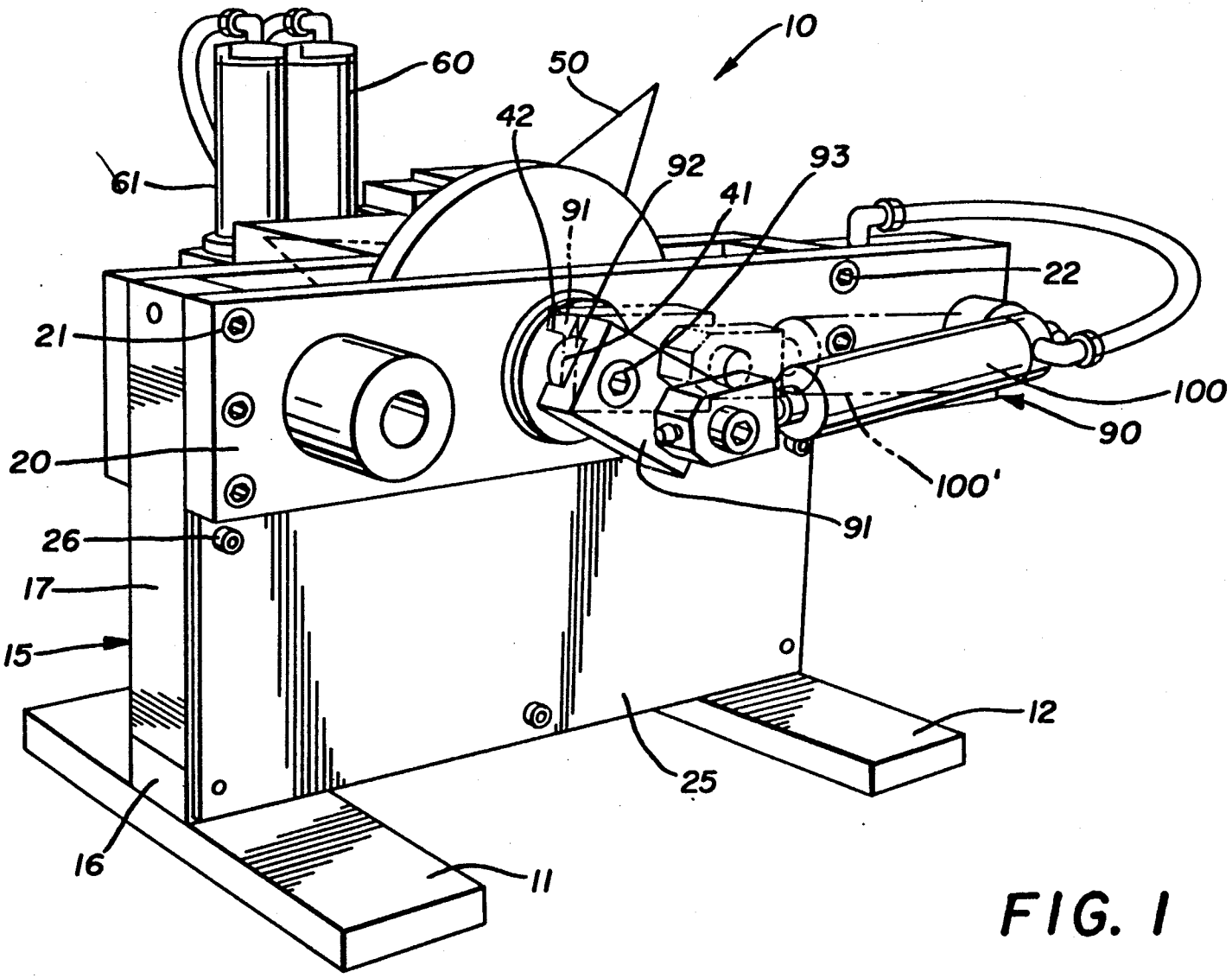
FIG. 1 is a perspective view of a flyknife cutter embodying the concepts of the present invention and showing the front side of the cutter and particularly the power and braking cylinder.
Figure 2:
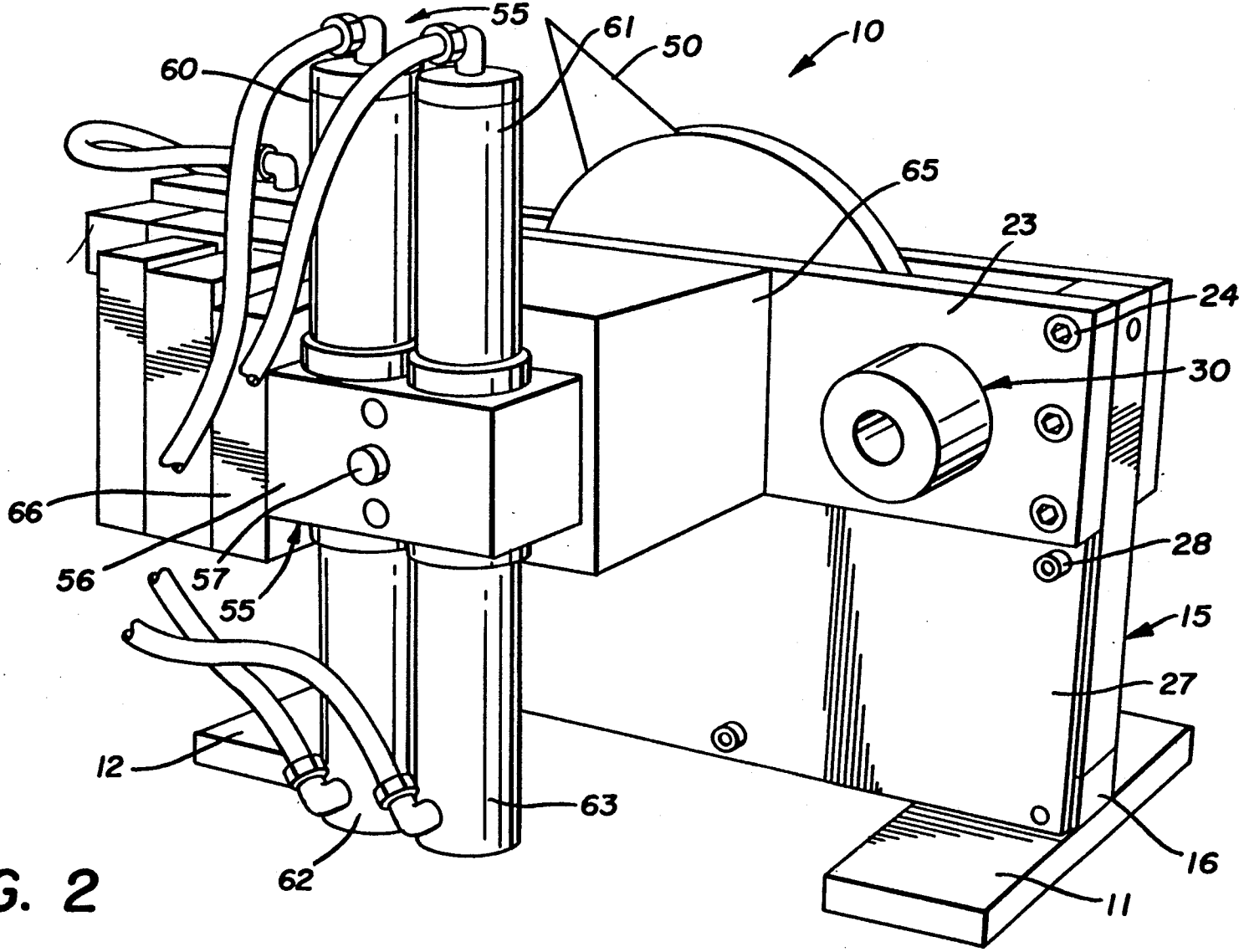
FIG. 2 is a perspective view of the flyknife cutter of FIG. 1 which is somewhat similar to FIG. 1 but showing the rear side of the cutter and particularly the rotary actuator.
Figure 3:
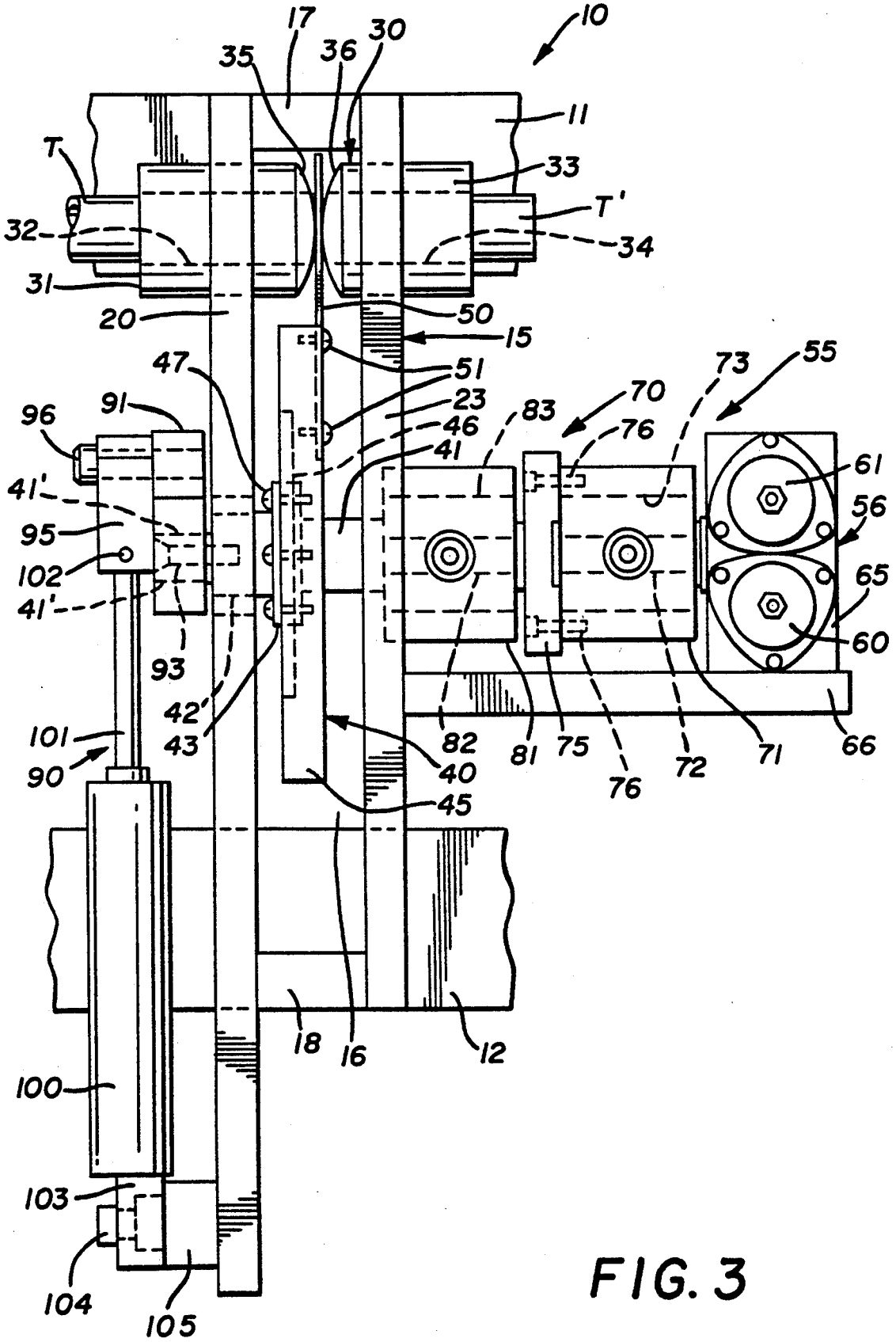
FIG. 3 is a top plan view of the flyknife cutter of FIG. 1 showing particularly the interrelation of the cutting knife with the other operative components of the system and having the clutch housing removed.

Exemplary flyknife cutter apparatus embodying the concepts of the present invention for repeatedly severing extruded rubber and plastic material is generally indicated by the numeral 10 in FIGS. 1–3 of the drawings. The cutting apparatus 10 is hereinafter described in the environment of on-line processing of a continuous length of rubber or plastic material being emitted from an extruder; however, the apparatus could be otherwise embodied in off-line processing of severed links of rubber or plastic material being cut into shorter lengths.

As shown in the drawings, the flyknife cutter apparatus 10 is provided with a pair of legs 11 and 12 which are spaced generally parallel members lying in a common plane. As shown for exemplary purposes, the legs 11 and 12 are a pair of bars which are adapted to be horizontally positioned for mounting the flyknife cutting apparatus 10 on a platform or table (not shown).

Rigidly attached to and projecting substantially vertically from each of the legs 11, 12 is a frame, generally indicated by the numeral 15. The frame 15 is a generally U-shaped configuration which is upwardly open as formed by a bottom plate 16, a guide end upright 17 extending vertically and substantially perpendicular to the bottom plate 16, and a cylinder end upright 18 at the end of bottom plate 16 opposite the guide end upright 17 which similarly extends substantially perpendicular to the bottom plate 16 (FIG. 3). These members of the frame 15 and the legs 11, 12 are rigidly interconnected as by welds, machine screws or other appropriate fastening elements. Proximate the upper extremity of the uprights 17, 18, material entrance and support plate 20 is attached to one side of the uprights 17, 18 as by machine screws 21 and 22, respectively (see FIG. 1). Spaced from and paralleling the material entrance and support plate 20 and lying in a plane parallel thereto to form a rectangular housing is a material exit and support plate 23 which is similarly attached proximate the upper extremities of uprights 17 and 18 as by machine screws 24.

For safety considerations which will become apparent hereinafter, an entrance guard plate 25 (Fi9. 1) covers the rectangular opening extending vertically between the entrance plate 20 and the bottom plate 16 and laterally between the guide end upright 17 and the cylinder end upright 18. The entrance guard plate 25 may be secured in position for selective removal and the resultant access to cutting apparatus 10 by a plurality of machine screws 26. Similarly, an exit guard plate 27 (Fi9. 2) is positioned on the other side of cutting apparatus 10 to cover the same rectangular opening in that it extends vertically between the exit plate 23 and the bottom plate 16 and laterally between guide end upright 17 and cylinder end upright 18. Exit guard plate 27 may be secured in a manner similar to entrance guard plate 25 as by machine screws 28. An enclosed downwardly open guard cover (not shown) is normally positioned above the support plates 20, 23 in order to complete essentially a fully enclosed structure.

Lengths of extruded rubber or plastic material, which are fed into, proximity to the cutting apparatus 10 by any of a variety of feed mechanisms well known in the art or even manually, are input to a material guide assembly, generally indicated by the numeral 30. The material guide assembly 30 includes a material entrance guide bushing 31 which is mounted in the material entrance and support plate 20. As shown, the guide bushing 31 has a bore 32 adapted to receive extruded material which is shown as an extent of tubing T in FIG. 3 of the drawings for purposes of example. The material entrance guide bushing 31 axially adjustably extends to a position substantially medially between the material entrance and support plate 20 and the material exit and support plate 23. Disposed proximate to but spaced a distance from the material entrance guide bushing 31 is a material exit guide bushing 33 which is similarly axially adjustably mounted in the material exit and support plate 23. As shown, the material exit guide bushing 33 has a bore 34 which is shown emitting tubing T' which has been severed by the cutting apparatus 10. The guide bushings 31, 33 may have curvilinear surfaces 35 and 36, respectively, at their juxtapositioned extremities interiorly of the cutting apparatus 10.

Mounted substantially centrally of and between the plates 20, 23 is a cutting mechanism generally indicated by the numeral 40. The cutting mechanism 40 has an arbor 41 which is suspended between and extends through the plates 20, 23 of the frame 15. The arbor 41 is freely rotatably supported in a bearing 42 which is positioned in the material entrance and support plate 20 (see FIGS. 1 and 3). The arbor 41 has a radially projecting collar 43 disposed intermediate the support plates 20, 23. The collar 43 of arbor 41 of cutting mechanism 40 mounts a flywheel 45, which is preferably a generally circular member having a substantial axial thickness and which due to its preferably metal composition has substantial weight that develops significant momentum when rotated at any substantial angular velocity. The flywheel 45 has a recess 46 which receives the collar 43 of the arbor 41. The flywheel 45 is rigidly attached to the arbor 41 as by a plurality of machine screws 47 which extend through the collar 43 of arbor 41 into the flywheel 45. It will thus be appreciated that the flywheel 45 will at all times rotate with the arbor 41.

The cutting mechanism 40 also includes as a principal component thereof a knife blade 50. The knife blade 50 is attached to the flywheel 45 in a manner such as to project radially outwardly of the radial outward extent of flywheel 45. As best seen in FIG. 3 the knife blade 50 may be an industrial blade of any of various types known to persons skilled in the art which may be attached to the axial face of the flywheel 45 opposite the recess 46 as by a plurality of machine screws 51. As will be appreciated by viewing particularly FIG. 3, the knife blade 50 is of such a radial extent such that it passes between the entrance and exit guide bushings 31, 33 of the material guide assembly 30, while the flywheel 45 is of such a reduced diameter that it does not interfere with the components of material guide assembly 30. The knife blade 50 and the surfaces 35 and 36 of entrance and exit guide bushings 31 and 33, respectively, should be adjusted to be in the closest possible proximity without contact engagement during rotation of knife blade 50 with the flywheel 45. It will be appreciated by persons skilled in the art that such adjustment will provide maximum support to the tubing T in the cutting area between the entrance and exit guide bushings 31, 33.

The cutting mechanism 40 is powered in part by a main drive mechanism, generally indicated, by the numeral 55. The drive mechanism 55 has as the principal motive component thereof a rotary actuator 56. The rotary actuator, generally indicated by the numeral 56, may be of a type which has a single shaft 57 which is selectively actuated by a pair of upper pneumatic cylinders 60 and 61 and a pair of lower pneumatic cylinders 62 and 63 (see FIGS. 2 and 3). The shaft 7 has an internal pinion portion (not shown) which is engaged by a pair of racks (not shown) which connect the cylinders 60 and 62 and 61 and 63, respectively. It will be appreciated that actuating opposite top and bottom cylinders will impart an extent of rotation to the shaft 57. As viewed for example in FIG. 2 it will be understood that the instantaneous actuation of cylinders 61 and 62 will impart rotation to the shaft 57 in a clockwise direction as viewed in FIG. 2 of a definitive angular arc, for example, approximately 60°. It will also be understood that if the cylinders 60–63, inclusive, are all of comparable characteristics, including the throw of the piston rod, that the actuation of cylinders 60 and 63 would rotate the shaft 57 through the same angular arc in the opposite direction (counter clockwise as viewed in FIG. 2) and thus return the shaft 57 to its original angular position. The rotary actuator 56 may have a housing 65 on which cylinders 60–63 are mounted and by which it is supported on an actuator mounting plate 66 which may be attached in cantilever fashion on support plate 23 of frame 15.

The drive mechanism 55 has coupled to the rotary actuator 56 a clutch assembly, generally indicated by the numeral 70 in FIG. 3. The clutch assembly 70 includes a first clutch 71 which is a one-way clutch that selectively transmits rotation of the shaft 57. In the example shown in the drawings, the clutch 71 transmits only rotation of shaft 57 in a clockwise direction as viewed in FIG. 2. As somewhat schematically depicted in FIG. 3, the clutch 71 has an inner race 72 which is coupled to the shaft 57 and an outer race 73 spaced a distance radially outwardly of the inner race 72. The clutch 71 may advantageously be of a type which employs what may be termed a stepless rachet construction wherein a plurality of tines (not shown) are interposed between the inner race 72 and the outer race 73. The tines interlock the inner race 72 and the outer race 73 when the shaft 57 is rotated clockwise as viewed in FIG. 2. Since the clutch 71 is a one way or one directional drive type, the tines do not interlock with the races 72, 73 when the shaft 57 is rotated counter clockwise as viewed in FIG. 2, such that the outer race 73 is never rotated in a counter clockwise direction as viewed in FIG. 2.

The outer race 73 of clutch 71 is rigidly attached to a clutch support and transmission mechanism 75 as by machine screws 76. The clutch support and transmission mechanism 75 may have on the side opposite the clutch 71 a second clutch 81. The second clutch 81 may conveniently be of the same operating type as the clutch 71. The clutch 81 has an inner race 82 which is affixed to the clutch support and transmission mechanism 75 to thus rotate with the outer race 73 of clutch 71. The inner race 82 of clutch 81 is also rigidly attached to and rotates the arbor 41 of cutting mechanism 40. The clutch 81 is configured such that the outer race 83 is rigidly and therefor. nonrotatably affixed as by attachment to the frame 15 and particularly support plate 23 as by a weld (not shown) or other appropriate fastener. The second clutch 81 is configured such that the tines do not interengage the inner race 82 and the outer race 83 when inner race 82 is rotated clockwise as viewed in FIGS. 2 and 3 with the shaft 57 and the outer race 73 of the clutch 71. It is however to be appreciated that the inner race 82 and thus the arbor 41 of cutting mechanism 40 cannot be rotated counter clockwise as viewed in FIGS. 2 and 3 at any time since any counter clockwise rotation of the inner race 82 causes the tines of clutch 81 to interlock the inner race 82 and the outer race 83. With the outer race 83 being non-rotatably fixed to the frame 15, the counter clockwise rotation of inner race 82 and arbor 41 as well as the flywheel 45 and knife 50 are therefore absolutely precluded for a purpose to be discussed hereinafter.

Positioned to the other side of the frame 15 from the main drive mechanism 55 is a supplemental drive and braking mechanism, generally indicated by the numeral 90. The supplemental drive and braking mechanism 90 includes a brake arm 91 which is attached to the arbor 41 axially outwardly of the bearing 42 in support plate 20. As best seen in FIGS. 1 and 3, the arbor 41 has at its axial extremity diametrically opposite flats 41' (FIG. 3) which engage a slot 92 in the brake arm 91 such that the brake arm is attached to the arbor 41 for rotation therewith. A machine screw 93 is inserted from axially outwardly of the brake arm 91 and threads into the arbor 41 to preclude brake arm 91 from being axially displaced from the extremity of arbor 41. Attached to and positioned axially outwardly of the brake arm 91 is a rod arm 95. The rod arm 95 has a pin 96 at one extremity thereof which extends through the rod arm 95 in the end of brake arm 91 opposite the end having the machine screw 93 and the slot 92 to which the arbor 41 is attached. Operatively connected to the rod arm 95 at the end opposite pin 96 is a cylinder 100 which may be a conventional pneumatic cylinder. The cylinder 100 has a rod 101 which is affixed to the rod arm 95 as by a pin 102. The end of the cylinder 100 opposite the cylinder rod 101 has an extending cylinder coupling 103. The cylinder coupling 103 is freely rotatably mounted on a pin 104 which extends from a cylinder mount 105 that is rigidly attached to the plate 20 of the frame 15. It will thus be seen that the cylinder 100 is free to pivotally move about the pin 104 which is mounted in the cylinder mount 105 that is rigidly attached to frame 15 of the cutting apparatus 10.

In operation, the cutting apparatus 10 cycles from a stop position where the knife blade 50 is substantially aligned with the support plates 20, 23 and 180° displaced from the position between the plates 20, 23 where the knife blade 50 is positioned in the cutting area between the guide bushings 31, 33 of the material guide assembly 30. When an actuating signal is received by cutting apparatus 10, whether from automatic feed mechanism or otherwise, the main drive mechanism 55 is initially energized. This is effected by supplying compressed air to the rotary actuator 56 and particularly to the cylinders 61 and 62 thereof. The resultant clockwise rotation of the shaft 57 produces as hereinabove described an equivalent rotation of the arbor 41, flywheel 45 and knife blade 50 from the stop or at rest position to an accelerating condition passing through the position depicted in FIGS. 1 and 2 of the drawings.

When the knife blade 50 rotates to a position slightly further clockwise from that depicted in FIG. 2, the supply of air to cylinders 61 and 62 is terminated approximately at the time in the rotation cycle when the cylinder 100 and rod 101 are in direct axial alignment with the brake arm 91 as may be appreciated from FIG. 1 of the drawings. Preferably substantially simultaneously with this termination of the supply of compressed air to cylinders 61 and 62 compressed air is supplied as by a solenoid to the cylinder 100 of the supplemental drive and braking mechanism 90. The cylinder rod 101 of cylinder 100 has just passed its point of maximum retraction into cylinder 100 such that the cylinder 100 is appropriately poised for institution of a power stroke by the cylinder rod 101 through the brake arm 91 to thus impart additional accelerating forces to the flywheel 45 carrying the knife blade 50.

Due to the substantially linear alignment of the arbor 41, guide bushings 31, 33 and the cylinder mount 105, the actuation of cylinder 100 continues to supply the flywheel 45 and knife blade 50 with accelerating forces creating increasing angular velocity. It will thus be appreciated that when the knife blade 50 reaches the cutting area between bushings 31, 33 the angular velocity is such that the inertia of flywheel 45 gives the knife blade 50 sufficient momentum which coupled with the sharp cutting edge thereof effects severing of tubing T or other profile reposing in the cutting area essentially without diminution of the angular velocity of the knife blade 50.

After the knife blade 50 passes the cutting area where the cylinder rod 101 of cylinder 100 is at its fully extended position the continued rotation of knife blade 50 downwardly commences a retraction of the cylinder rod 101 into cylinder 100 thereby compressing the compressed air supplied to cylinder 100 during the power stroke. The rapid compression of the air in cylinder 100 occasioned by the angular rotation of flywheel 45 supplies a strong braking force to the flywheel 45 which tends to decelerate and quickly reduce the angular velocity of the flywheel 45.

It will be appreciated that the relatively rapid and high extent of compression in the cylinder 100 could tend to cause the flywheel to bounce or rotate in a reverse direction, that is counter clockwise, as viewed in FIG. 2. In this context it is to be further appreciated that the second clutch 81 overcomes any such tendency in that its configuration and operation as described hereinabove precludes any reverse or counter clockwise rotation, as viewed in FIG. 2, of the arbor 41 to which flywheel 45 is attached. The knife blade 50 is thus quickly and smoothly brought to its original stop position and remains at rest until another cutting cycle is instituted. It is to be appreciated that the supply of compressed air to cylinder 100 may be terminated during the latter stages of braking or upon stopping of the knife blade 50. It is also to be appreciated that at any time after lhe supply of compressed air to the cylinders of 61 and 62 has been terminated and until the completion of the operating cycle, compressed air may be supplied to the cylinders 60 and 63 to reset or recycle the shaft 57 to its original position in preparation for the institution of the next operating cycle.

Thus it should be evident that the cutting apparatus for extruded rubber and plastic materials disclosed herein carries out the various objects of the invention set forth hereinabove and otherwise constitutes an advantageous contribution to the art. As may be apparent to persons skilled in the art, various modifications could be made to the preferred embodiment disclosed herein without departing from the spirit of the invention.

I claim:

1. Apparatus for repeatedly severing rubber and plastic material at selected locations along a length thereof comprising, frame means, arbor means mounted on said frame means carrying a knife blade for rotation in a circular path, guide means for supporting the material to be severed in the path of rotation of said knife blade, means for selectively intermittently driving said arbor means for instituting rotation of said knife blade, and a single means for both supplementing the driving of said arbor means and for braking said arbor means to a stop after said knife blade has severed the material.

2. Apparatus according to claim 1, wherein said means for selectively intermittently driving said arbor means includes rotary actuator means.

3. Apparatus according to claim 2, including one directional drive clutch means interposed between said rotary actuator means and said arbor means.

4. Apparatus according to claim 3, wherein said rotary actuator means includes cylinder means for actuating shaft means connected to said clutch means.

5. Apparatus according to claim 1, including flywheel means nonrotatably attached to said arbor means, said knife blade being mounted on said flywheel means.

6. Apparatus according to claim 5, wherein said frame means includes spaced, parallel support plates suspending said arbor means and partially enclosing said flywheel means.

7. Apparatus according to claim 6, including guard means substantially enclosing said flywheel means and said knife blade means.

8. Apparatus according to claim 1, wherein said guide means include a pair of bushings mounted in said frame means and having axial bore means therein for passing the material.

9. Apparatus according to claim 8, wherein said guide bushings are in close axial proximity but spaced a sufficient distance to permit said knife blade to pass therebetween without contact engagement therewith.

10. Apparatus according to claim 1, wherein said means for supplementing the driving of said arbor means and for braking said arbor means is cylinder means, the power stroke of said cylinder means supplementing the driving of said arbor means and the return stroke effecting braking of said arbor means.

11. Apparatus according to claim 10, wherein said cylinder means operates on said arbor means through brake arm means attached to said arbor means.

12. Apparatus according to claim 11, wherein said cylinder means has rod means carrying rod end means freely rotatably attached to said brake arm means on a pivot pin and has coupling means pivotally attached to cylinder mount means on said frame means.

13. Apparatus according to claim 12, wherein said guide means, said arbor means and said cylinder means are substantially linearly aligned.

14. Apparatus according to claim 1, including first clutch means for selectively intermittently driving said arbor means and second clutch means preventing reverse rotation of said arbor means.

15. Apparatus according to claim 14, wherein said second clutch means is a one directional drive clutch having one race thereof attached to said arbor means and the other race thereof attached to said frame means.

16. Apparatus according to claim 15, wherein said first clutch means is a one directional drive clutch having an inner race attached to a rotary actuator and an outer race attached to transmission means, said transmission means being attached to said race of said second clutch means attached to said arbor means.

17. Apparatus for repeatedly severing rubber and plastic material at selected locations along a length thereof comprising, frame means, arbor means mounted on said frame means carrying a knife blade for rotation in a circular path, guide means for supporting the material to be severed in the path of rotation of said knife blade, means for selectively intermittently driving said arbor means for instituting rotation of said knife blade, and cylinder means opposing the rotation of said arbor means to conclude rotation of the arbor means after said knife blade has severed the material wherein said cylinder means drives said arbor means during a portion of each revolution thereof.

18. Apparatus according to claim 17, wherein said means for selectively intermittently driving said arbor means includes rotary actuator means operating through clutch means attached to said arbor means.

19. Apparatus according to claim 18, wherein said rotary actuator means and said cylinder means sequentially drive said arbor means.

* * * * *

UNITED STATES PATENT AND TRADEMARK OFFICE

CERTIFICATE OF CORRECTION

PATENT NO. : 5,024,130

DATED : June 18, 1991

INVENTOR(S) : DONALD F. HAYS, JR.

It is certified that error appears in the above-identified patent and that said Letters Patent is hereby corrected as shown below:

Column 4, line 44, "(Fi9. 1)" should read --(FIG. 1)--.

Column 4, line 52, "(Fi9. 2)" should read --(FIG. 2)--.

Column 4, line 63, "into, proximity" should read --into proximity--.

Column 6, line 3, "7" should read --57--.

Column 6, line 16, "rod, that the" should read --rod, the--.

Column 6, line 60, "therefor." should read --therefore--.

Column 8, line 48, "1he supply" should read --the supply--.

Signed and Sealed this

Sixteenth Day of March, 1993

*Attest:*

STEPHEN G. KUNIN

*Attesting Officer*

*Acting Commissioner of Patents and Trademarks*